US007988247B2

(12) United States Patent
Letendre et al.

(10) Patent No.: US 7,988,247 B2
(45) Date of Patent: Aug. 2, 2011

(54) EJECTION OF DROPS HAVING VARIABLE DROP SIZE FROM AN INK JET PRINTER

(75) Inventors: William Letendre, Etna, NH (US); Robert Hasenbein, Enfield, NH (US); Deane A. Gardner, Cupertino, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 81 days.

(21) Appl. No.: 11/652,325

(22) Filed: Jan. 11, 2007

(65) Prior Publication Data

US 2008/0170088 A1 Jul. 17, 2008

(51) Int. Cl.
*B41J 2/05* (2006.01)

(52) U.S. Cl. ..... 347/9; 347/10; 347/11

(58) Field of Classification Search ..... 347/5, 9, 347/10, 11, 12
See application file for complete search history.

(56) References Cited

U.S. PATENT DOCUMENTS

| | | | |
|---|---|---|---|
| 2,892,107 | A | 6/1959 | Gravley et al. |
| 3,946,398 | A | 3/1976 | Kyser et al. |
| 4,005,440 | A | 1/1977 | Amberntsson |
| 4,051,582 | A | 10/1977 | Eschler et al. |
| 4,106,976 | A | 8/1978 | Chiou et al. |
| 4,158,847 | A | 6/1979 | Heinzl et al. |
| 4,189,734 | A | 2/1980 | Kyser et al. |
| 4,216,483 | A | 8/1980 | Kyser et al. |
| 4,266,232 | A | 5/1981 | Juliana et al. |
| 4,339,763 | A | 7/1982 | Kyser et al. |
| 4,355,256 | A | 10/1982 | Perduijn et al. |
| 4,393,384 | A | 7/1983 | Kyser |
| 4,396,923 | A | 8/1983 | Noda |
| 4,480,259 | A | 10/1984 | Kruger et al. |
| 4,504,845 | A | 3/1985 | Kattner et al. |
| 4,510,503 | A | 4/1985 | Paranjpe et al. |
| 4,513,299 | A | 4/1985 | Lee et al. |
| 4,516,140 | A | 5/1985 | Durkee et al. |
| 4,523,200 | A | 6/1985 | Howkins |
| 4,528,574 | A | 7/1985 | Boyden |
| 4,584,590 | A | 4/1986 | Fischbeck et al. |
| 4,620,123 | A | 10/1986 | Farrall et al. |
| 4,627,138 | A | 12/1986 | Im |
| 4,639,735 | A | 1/1987 | Yamamoto et al. |
| 4,641,153 | A | 2/1987 | Cruz-Uribe |

(Continued)

FOREIGN PATENT DOCUMENTS

CN 101094770 A 12/2007

(Continued)

OTHER PUBLICATIONS

U.S. Appl. No. 09/412,827 (issued as patent No. 6,755,511).

(Continued)

*Primary Examiner* — Lam S Nguyen
(74) *Attorney, Agent, or Firm* — Fish & Richardson P.C.

(57) ABSTRACT

A method for causing ink to be ejected from an ink chamber of an ink jet printer includes causing a first bolus of ink to be extruded from the ink chamber; and following lapse of a selected interval, causing a second bolus of ink to be extruded from the ink chamber. The interval is selected to be greater than the reciprocal of the fundamental resonant frequency of the chamber, and such that the first bolus remains in contact with ink in the ink chamber at the time that the second bolus is extruded.

19 Claims, 6 Drawing Sheets

U.S. PATENT DOCUMENTS

| | | | |
|---|---|---|---|
| 4,665,409 | A | 5/1987 | Behrens et al. |
| 4,670,074 | A | 6/1987 | Broussoux et al. |
| 4,672,398 | A | 6/1987 | Kuwabara et al. |
| 4,680,595 | A | 7/1987 | Cruz-Uribe et al. |
| 4,686,539 | A | 8/1987 | Schmidle et al. |
| 4,695,852 | A | 9/1987 | Scardovi |
| 4,695,854 | A | 9/1987 | Cruz-Uribe |
| 4,703,333 | A | 10/1987 | Hubbard |
| 4,714,935 | A | 12/1987 | Yamamoto et al. |
| 4,717,927 | A | 1/1988 | Sato |
| 4,726,099 | A | 2/1988 | Card et al. |
| 4,728,969 | A | 3/1988 | Le et al. |
| 4,730,197 | A | 3/1988 | Raman et al. |
| 4,769,653 | A | 9/1988 | Shimoda |
| 4,774,530 | A | 9/1988 | Hawkins |
| 4,789,425 | A | 12/1988 | Drake et al. |
| 4,812,199 | A | 3/1989 | Sickafus |
| 4,835,554 | A | 5/1989 | Hoisington et al. |
| 4,863,560 | A | 9/1989 | Hawkins |
| 4,891,654 | A | 1/1990 | Hoisington et al. |
| 4,899,178 | A | 2/1990 | Tellier |
| 4,966,037 | A | 10/1990 | Sumner et al. |
| 4,972,211 | A | 11/1990 | Aoki |
| 4,987,429 | A | 1/1991 | Finley et al. |
| 5,000,811 | A | 3/1991 | Campanelli |
| 5,023,625 | A | 6/1991 | Bares et al. |
| 5,041,190 | A | 8/1991 | Drake et al. |
| 5,096,535 | A | 3/1992 | Hawkins et al. |
| 5,109,233 | A | 4/1992 | Nishikawa |
| 5,124,717 | A | 6/1992 | Campanelli et al. |
| 5,124,722 | A | 6/1992 | Moriyama et al. |
| 5,172,134 | A | 12/1992 | Kishida et al. |
| 5,172,141 | A | 12/1992 | Moriyama |
| 5,173,717 | A | 12/1992 | Kishida et al. |
| 5,202,659 | A | 4/1993 | Debonte |
| 5,202,703 | A | 4/1993 | Hoisington et al. |
| 5,204,690 | A | 4/1993 | Lorenze, Jr. et al. |
| 5,204,695 | A | 4/1993 | Tokunaga et al. |
| 5,221,931 | A | 6/1993 | Moriyama |
| 5,223,937 | A | 6/1993 | Moriguchi et al. |
| 5,227,813 | A | 7/1993 | Pies et al. |
| 5,235,352 | A | 8/1993 | Pies et al. |
| 5,264,865 | A | 11/1993 | Shimoda et al. |
| 5,265,315 | A | 11/1993 | Hoisington et al. |
| 5,278,585 | A | 1/1994 | Karz et al. |
| 5,280,310 | A | 1/1994 | Otsuka et al. |
| 5,285,215 | A | 2/1994 | Liker |
| 5,298,923 | A | 3/1994 | Tokunaga et al. |
| 5,305,024 | A | 4/1994 | Moriguchi et al. |
| 5,329,293 | A | 7/1994 | Liker |
| 5,353,051 | A | 10/1994 | Katayama et al. |
| 5,354,135 | A | 10/1994 | Sakagami et al. |
| 5,361,084 | A | 11/1994 | Paton |
| 5,371,520 | A | 12/1994 | Kubota |
| 5,374,332 | A | 12/1994 | Koyama et al. |
| 5,376,856 | A | 12/1994 | Takeuchi et al. |
| 5,376,857 | A | 12/1994 | Takeuchi et al. |
| 5,381,166 | A | 1/1995 | Lam et al. |
| 5,385,635 | A | 1/1995 | O'Neill |
| 5,387,314 | A | 2/1995 | Baughman et al. |
| 5,402,926 | A | 4/1995 | Takeuchi et al. |
| 5,406,682 | A | 4/1995 | Zimnicki et al. |
| 5,408,739 | A | 4/1995 | Altavela et al. |
| 5,414,916 | A | 5/1995 | Hayes |
| 5,430,344 | A | 7/1995 | Takeuchi et al. |
| 5,438,350 | A | 8/1995 | Kerry |
| 5,446,484 | A | 8/1995 | Hoisington et al. |
| 5,459,501 | A | 10/1995 | Lee et al. |
| 5,463,413 | A | 10/1995 | Ho et al. |
| 5,463,414 | A | 10/1995 | Temple et al. |
| 5,463,416 | A | 10/1995 | Paton et al. |
| 5,466,985 | A | 11/1995 | Suzuki |
| 5,475,279 | A | 12/1995 | Takeuchi et al. |
| 5,477,246 | A | 12/1995 | Hirabayashi et al. |
| 5,477,344 | A | 12/1995 | Lubinsky et al. |
| 5,484,507 | A | 1/1996 | Ames |
| 5,489,930 | A | 2/1996 | Anderson |
| 5,495,270 | A | 2/1996 | Burr et al. |
| 5,500,988 | A | 3/1996 | Moynihan et al. |
| 5,501,893 | A | 3/1996 | Laermer et al. |
| 5,502,471 | A | 3/1996 | Obermeier et al. |
| 5,510,816 | A | 4/1996 | Hosono et al. |
| 5,512,793 | A | 4/1996 | Takeuchi et al. |
| 5,512,922 | A | 4/1996 | Paton |
| 5,518,952 | A | 5/1996 | Vonasek et al. |
| 5,552,809 | A | 9/1996 | Hosono et al. |
| 5,576,743 | A | 11/1996 | Momose et al. |
| 5,581,286 | A | 12/1996 | Hayes et al. |
| 5,581,288 | A | 12/1996 | Shimizu et al. |
| 5,592,042 | A | 1/1997 | Takuchi et al. |
| 5,594,476 | A | 1/1997 | Tokunaga et al. |
| 5,605,659 | A | 2/1997 | Moynihan et al. |
| 5,617,127 | A | 4/1997 | Takeuchi et al. |
| 5,622,748 | A | 4/1997 | Takeuchi et al. |
| 5,631,040 | A | 5/1997 | Takuchi et al. |
| 5,631,675 | A | 5/1997 | Futagawa |
| 5,640,184 | A | 6/1997 | Moynihan et al. |
| 5,643,379 | A | 7/1997 | Takeuchi et al. |
| 5,655,538 | A | 8/1997 | Lorraine et al. |
| 5,657,060 | A | 8/1997 | Sekiya et al. |
| 5,657,063 | A | 8/1997 | Takahashi |
| 5,658,471 | A | 8/1997 | Murthy et al. |
| 5,659,346 | A | 8/1997 | Moynihan |
| 5,665,249 | A | 9/1997 | Burke et al. |
| 5,666,143 | A | 9/1997 | Burke et al. |
| 5,670,999 | A | 9/1997 | Takeuchi et al. |
| 5,689,291 | A | 11/1997 | Tence et al. |
| 5,691,593 | A | 11/1997 | Takeuchi et al. |
| 5,691,594 | A | 11/1997 | Takeuchi et al. |
| 5,691,752 | A | 11/1997 | Moynihan et al. |
| 5,704,105 | A | 1/1998 | Venkataramani et al. |
| 5,710,584 | A | 1/1998 | Suzuki et al. |
| 5,718,044 | A | 2/1998 | Baughman et al. |
| 5,724,082 | A | 3/1998 | Moynihan |
| 5,729,257 | A | 3/1998 | Sekiya et al. |
| 5,731,828 | A | 3/1998 | Ishinaga et al. |
| 5,734,399 | A | 3/1998 | Weber et al. |
| 5,736,993 | A | 4/1998 | Regimbal et al. |
| 5,739,828 | A | 4/1998 | Moriyama et al. |
| 5,745,131 | A | 4/1998 | Kneezel et al. |
| 5,752,303 | A | 5/1998 | Thiel et al. |
| 5,755,909 | A | 5/1998 | Gailus |
| 5,757,400 | A | 5/1998 | Hoisington |
| 5,777,639 | A | 7/1998 | Kageyama et al. |
| 5,790,156 | A | 8/1998 | Mutton et al. |
| 5,793,394 | A | 8/1998 | Kato |
| 5,798,772 | A | 8/1998 | Tachihara et al. |
| 5,818,476 | A | 10/1998 | Mey et al. |
| 5,818,482 | A | 10/1998 | Ohta et al. |
| 5,821,841 | A | 10/1998 | Furlani et al. |
| 5,821,953 | A | 10/1998 | Nakano et al. |
| 5,821,972 | A | 10/1998 | Mey et al. |
| 5,825,385 | A | 10/1998 | Silverbrook |
| 5,834,880 | A | 11/1998 | Venkataramani et al. |
| 5,841,452 | A | 11/1998 | Silverbrook |
| D402,687 | S | 12/1998 | Sabonis |
| 5,850,241 | A | 12/1998 | Silverbrook |
| 5,852,860 | A | 12/1998 | Lorraine et al. |
| 5,855,049 | A | 1/1999 | Corbett, III et al. |
| 5,861,902 | A | 1/1999 | Beerling |
| D405,822 | S | 2/1999 | Sabonis |
| 5,870,123 | A | 2/1999 | Lorenze, Jr. et al. |
| 5,870,124 | A | 2/1999 | Silverbrook |
| 5,871,656 | A | 2/1999 | Silverbrook |
| 5,880,759 | A | 3/1999 | Silverbrook |
| 5,883,651 | A | 3/1999 | Thiel et al. |
| 5,889,544 | A | 3/1999 | Mey et al. |
| 5,901,425 | A | 5/1999 | Bibl et al. |
| 5,903,286 | A | 5/1999 | Takahashi |
| 5,907,340 | A | 5/1999 | Katakura |
| 5,927,206 | A | 7/1999 | Bacon et al. |
| 5,933,170 | A | 8/1999 | Takeuchi et al. |
| 5,946,012 | A | 8/1999 | Courian et al. |
| D417,233 | S | 11/1999 | Sabonis |
| 5,975,667 | A | 11/1999 | Moriguchi et al. |
| 5,980,015 | A | 11/1999 | Saruta |
| 5,988,785 | A | 11/1999 | Katayama |

5,997,122 A 12/1999 Moriyama et al.
5,997,123 A 12/1999 Takekoshi et al.
6,007,174 A 12/1999 Hirabayashi et al.
6,012,799 A 1/2000 Silverbrook
6,019,457 A 2/2000 Silverbrook
6,020,905 A 2/2000 Cornell et al.
6,022,101 A 2/2000 Sabonis
6,022,752 A 2/2000 Hirsh et al.
6,029,896 A 2/2000 Self et al.
6,030,065 A 2/2000 Fukuhata
6,031,652 A 2/2000 Furlani et al.
6,033,060 A 3/2000 Minami
6,036,874 A 3/2000 Farnaam
6,037,957 A 3/2000 Granet et al.
6,039,425 A 3/2000 Sekiya et al.
6,042,219 A 3/2000 Higashino et al.
6,044,646 A 4/2000 Silverbrook
6,045,710 A 4/2000 Silverbrook
6,046,822 A 4/2000 Wen et al.
6,047,600 A 4/2000 Ottosson
6,047,816 A 4/2000 Moghadam et al.
6,059,394 A 5/2000 Moriyama
6,062,681 A 5/2000 Field et al.
6,067,183 A 5/2000 Furlani et al.
6,070,310 A 6/2000 Ito et al.
6,071,750 A 6/2000 Silverbrook
6,071,822 A 6/2000 Donohue et al.
6,074,033 A 6/2000 Sayama et al.
6,086,189 A 7/2000 Hosono et al.
6,087,638 A 7/2000 Silverbrook
6,088,148 A 7/2000 Furlani et al.
6,089,690 A 7/2000 Hotomi
6,089,696 A 7/2000 Lubinsky
6,092,886 A 7/2000 Hosono
6,095,630 A 8/2000 Horii et al.
6,097,406 A 8/2000 Lubinsky et al.
6,099,103 A 8/2000 Takahashi
6,102,513 A 8/2000 Wen
6,106,091 A 8/2000 Osawa et al.
6,106,092 A 8/2000 Norigoe et al.
6,108,117 A 8/2000 Furlani et al.
6,109,746 A 8/2000 Jeanmaire et al.
6,113,209 A 9/2000 Nitta et al.
6,116,709 A 9/2000 Hirabayashi et al.
6,123,405 A 9/2000 Temple et al.
6,126,259 A 10/2000 Stango et al.
6,126,263 A 10/2000 Hotomi et al.
6,126,846 A 10/2000 Silverbrook
6,127,198 A 10/2000 Coleman et al.
6,140,746 A 10/2000 Miyashita et al.
6,143,190 A 11/2000 Yagi et al.
6,143,432 A 11/2000 deRochemont et al.
6,143,470 A 11/2000 Nguyen et al.
6,149,259 A 11/2000 Otsuka et al.
6,149,260 A 11/2000 Minakuti
6,151,050 A 11/2000 Hosono et al.
6,155,671 A 12/2000 Fukumoto et al.
6,161,270 A 12/2000 Ghosh et al.
6,174,038 B1 1/2001 Nakazawa et al.
6,176,570 B1 1/2001 Kishima et al.
6,179,978 B1 1/2001 Hirsh et al.
6,186,610 B1 2/2001 Kocher et al.
6,186,618 B1 2/2001 Usui et al.
6,188,416 B1 2/2001 Hayes
6,190,931 B1 2/2001 Silverbrook
6,193,343 B1 2/2001 Norigoe et al.
6,193,346 B1 2/2001 Nakano
6,193,348 B1 2/2001 Sekiya et al.
6,209,999 B1 4/2001 Wen et al.
6,213,588 B1 4/2001 Silverbrook
6,214,192 B1 4/2001 Hawkins et al.
6,214,244 B1 4/2001 Silverbrook
6,214,245 B1 4/2001 Hawkins et al.
6,217,141 B1 4/2001 Nakamura et al.
6,217,153 B1 4/2001 Silverbrook
6,217,155 B1 4/2001 Silverbrook
6,217,159 B1 4/2001 Morikoshi et al.
6,218,083 B1 4/2001 McCullough et al.
6,220,694 B1 4/2001 Silverbrook
6,227,653 B1 5/2001 Silverbrook
6,227,654 B1 5/2001 Silverbrook
6,228,668 B1 5/2001 Silverbrook
6,231,151 B1 5/2001 Hotomi et al.
6,234,608 B1 5/2001 Genovese et al.
6,234,611 B1 5/2001 Silverbrook
6,235,211 B1 5/2001 Silverbrook
6,235,212 B1 5/2001 Silverbrook
6,238,044 B1 5/2001 Silverbrook et al.
6,238,115 B1 5/2001 Silverbrook et al.
6,238,584 B1 5/2001 Hawkins et al.
6,239,821 B1 5/2001 Silverbrook
6,241,342 B1 6/2001 Silverbrook
6,241,904 B1 6/2001 Silverbrook
6,241,905 B1 6/2001 Silverbrook
6,241,906 B1 6/2001 Silverbrook
6,244,691 B1 6/2001 Silverbrook
6,245,246 B1 6/2001 Silverbrook
6,245,247 B1 6/2001 Silverbrook
6,247,776 B1 6/2001 Usui et al.
6,247,790 B1 6/2001 Silverbrook
6,247,791 B1 6/2001 Silverbrook
6,247,793 B1 6/2001 Silverbrook
6,247,794 B1 6/2001 Silverbrook
6,247,795 B1 6/2001 Silverbrook
6,247,796 B1 6/2001 Silverbrook
6,248,248 B1 6/2001 Silverbrook
6,248,249 B1 6/2001 Silverbrook
6,248,505 B1 6/2001 McCullough et al.
6,251,298 B1 6/2001 Silverbrook
6,252,697 B1 6/2001 Hawkins et al.
6,254,213 B1 7/2001 Ishikawa
6,254,793 B1 7/2001 Silverbrook
6,255,762 B1 7/2001 Sakamaki et al.
6,256,849 B1 7/2001 Kim
6,257,689 B1 7/2001 Yonekubo
6,258,284 B1 7/2001 Silverbrook
6,258,285 B1 7/2001 Silverbrook
6,258,286 B1 7/2001 Hawkins et al.
6,260,741 B1 7/2001 Pham-Van-Diep et al.
6,260,953 B1 7/2001 Silverbrook
6,263,551 B1 7/2001 Lorraine et al.
6,264,306 B1 7/2001 Silverbrook
6,264,307 B1 7/2001 Silverbrook
6,264,849 B1 7/2001 Silverbrook
6,267,905 B1 7/2001 Silverbrook
6,270,179 B1 8/2001 Nou
6,273,538 B1 8/2001 Mitsuhashi et al.
6,273,552 B1 8/2001 Hawkins et al.
6,274,056 B1 8/2001 Silverbrook
6,276,772 B1 8/2001 Sakata et al.
6,276,774 B1 8/2001 Moghadam et al.
6,276,782 B1 8/2001 Sharma et al.
6,280,643 B1 8/2001 Silverbrook
6,281,912 B1 8/2001 Silverbrook
6,281,913 B1 8/2001 Webb
6,283,568 B1 9/2001 Horii et al.
6,283,569 B1 9/2001 Otsuka et al.
6,283,575 B1 9/2001 Hawkins et al.
6,286,935 B1 9/2001 Silverbrook
6,290,315 B1 9/2001 Sayama
6,290,317 B1 9/2001 Hotomi
6,291,317 B1 9/2001 Salatino et al.
6,293,639 B1 9/2001 Isamoto
6,293,642 B1 9/2001 Sano
6,293,658 B1 9/2001 Silverbrook
6,294,101 B1 9/2001 Silverbrook
6,296,340 B1 10/2001 Tajika et al.
6,296,346 B1 10/2001 Seo et al.
6,299,272 B1 10/2001 Baket et al.
6,299,289 B1 10/2001 Silverbrook
6,299,300 B1 10/2001 Silverbrook
6,299,786 B1 10/2001 Silverbrook
6,303,042 B1 10/2001 Hawkins et al.
6,305,773 B1 10/2001 Burr et al.
6,305,788 B1 10/2001 Silverbrook
6,305,791 B1 10/2001 Hotomi et al.
6,306,671 B1 10/2001 Silverbrook
6,309,048 B1 10/2001 Silverbrook 6,309,054 B1 10/2001 Kawamura et al.
6,312,076 B1 11/2001 Taki et al.
6,312,096 B1 11/2001 Koitabashi et al.
6,312,114 B1 11/2001 Silverbrook
6,312,615 B1 11/2001 Silverbrook
6,315,399 B1 11/2001 Silverbrook
6,315,914 B1 11/2001 Silverbrook
6,318,849 B1 11/2001 Silverbrook
6,322,194 B1 11/2001 Silverbrook
6,322,195 B1 11/2001 Silverbrook
6,328,395 B1 * 12/2001 Kitahara et al. ..... 347/9
6,328,397 B1 12/2001 Shimizu et al.
6,328,398 B1 12/2001 Chang
6,328,399 B1 12/2001 Wen
6,328,402 B1 12/2001 Hotomi
6,328,417 B1 12/2001 Silverbrook
6,328,425 B1 12/2001 Silverbrook
6,328,431 B1 12/2001 Silverbrook
6,331,040 B1 12/2001 Yonekubo et al.
6,331,258 B1 12/2001 Silverbrook
6,336,715 B1 1/2002 Hotomi et al.
6,338,542 B1 1/2002 Fujimori
6,338,548 B1 1/2002 Silverbrook
6,340,222 B1 1/2002 Silverbrook
6,345,424 B1 2/2002 Hasegawa
6,345,880 B1 2/2002 DeBoer et al.
6,350,003 B1 2/2002 Ishikawa
6,350,019 B1 2/2002 Shingai et al.
6,352,328 B1 3/2002 Wen et al.
6,352,330 B1 3/2002 Lubinsky et al.
6,352,335 B1 3/2002 Koyama et al.
6,352,337 B1 3/2002 Sharma
6,352,814 B1 3/2002 McCullough et al.
6,354,686 B1 3/2002 Tanaka et al.
6,357,846 B1 3/2002 Kitahara
6,364,444 B1 4/2002 Ota
6,364,459 B1 4/2002 Sharma et al.
6,371,587 B1 4/2002 Chang
6,378,971 B1 4/2002 Tamura et al.
6,378,972 B1 4/2002 Akiyama et al.
6,378,973 B1 4/2002 Kubota et al.
6,378,989 B1 4/2002 Silverbrook
6,378,996 B1 4/2002 Shimada et al.
6,382,753 B1 5/2002 Teramae et al.
6,382,754 B1 5/2002 Morikoshi et al.
6,382,767 B1 5/2002 Greive
6,382,779 B1 5/2002 Silverbrook
6,382,782 B1 5/2002 Anagnostopoulos et al.
6,383,833 B1 5/2002 Silverbrook
6,386,664 B1 5/2002 Hosono et al.
6,386,679 B1 5/2002 Yang et al.
6,393,980 B2 5/2002 Simons
6,394,570 B1 5/2002 Inada
6,394,581 B1 5/2002 Silverbrook
6,398,331 B1 6/2002 Asaka et al.
6,398,344 B1 6/2002 Silverbrook
6,398,348 B1 6/2002 Haluzak et al.
6,402,278 B1 6/2002 Temple
6,402,282 B1 6/2002 Webb
6,402,300 B1 6/2002 Silverbrook
6,402,303 B1 6/2002 Sumi
6,406,129 B1 6/2002 Silverbrook
6,406,607 B1 6/2002 Hirsh et al.
6,409,295 B1 6/2002 Norigoe
6,409,316 B1 6/2002 Clark et al.
6,409,323 B1 6/2002 Silverbrook
6,412,908 B2 7/2002 Silverbrook
6,412,912 B2 7/2002 Silverbrook
6,412,914 B1 7/2002 Silverbrook
6,412,925 B1 7/2002 Takahashi
6,413,700 B1 7/2002 Hallman
6,416,149 B2 7/2002 Takahashi
6,416,168 B1 7/2002 Silverbrook
6,416,932 B1 7/2002 Ray et al.
6,419,337 B2 7/2002 Sayama
6,419,339 B2 7/2002 Takahashi
6,420,196 B1 7/2002 Silverbrook
6,422,677 B1 7/2002 Deshpande et al.
6,425,651 B1 7/2002 Silverbrook
6,425,661 B1 7/2002 Silverbrook et al.
6,425,971 B1 7/2002 Silverbrook
6,428,133 B1 8/2002 Silverbrook
6,428,134 B1 8/2002 Clark et al.
6,428,135 B1 8/2002 Lubinsky et al.
6,428,137 B1 8/2002 Iwaishi et al.
6,428,138 B1 8/2002 Asauchi et al.
6,428,146 B1 8/2002 Sharma et al.
6,428,147 B2 8/2002 Silverbrook
6,431,675 B1 8/2002 Chang
6,431,676 B2 8/2002 Asauchi et al.
6,435,666 B1 8/2002 Trauernicht et al.
6,439,695 B2 8/2002 Silverbrook
6,439,699 B1 8/2002 Silverbrook
6,439,701 B1 8/2002 Taneya et al.
6,439,703 B1 8/2002 Anagnostopoulos et al.
6,439,704 B1 8/2002 Silverbrook
6,443,547 B1 9/2002 Takahashi et al.
6,450,602 B1 9/2002 Lubinsky et al.
6,450,603 B1 9/2002 Chang
6,450,615 B2 9/2002 Kojima et al.
6,450,619 B1 9/2002 Anagnostopoulos et al.
6,450,627 B1 9/2002 Moynihan et al.
6,450,628 B1 9/2002 Jeanmaire et al.
6,451,216 B1 9/2002 Silverbrook
6,453,526 B2 9/2002 Lorraine et al.
6,454,396 B2 9/2002 Silverbrook
6,457,795 B1 10/2002 Silverbrook
6,457,807 B1 10/2002 Hawkins et al.
6,460,778 B1 10/2002 Silverbrook
6,460,959 B1 10/2002 Momose et al.
6,460,960 B1 10/2002 Mitsuhashi
6,463,656 B1 10/2002 Debesis et al.
6,464,315 B1 10/2002 Otokita et al.
6,467,865 B1 10/2002 Iwamura et al.
6,467,885 B2 10/2002 Tanaka
6,471,336 B2 10/2002 Silverbrook
6,474,762 B2 11/2002 Taki et al.
6,474,781 B1 11/2002 Jeanmaire
6,474,789 B1 11/2002 Ishinaga et al.
6,474,794 B1 11/2002 Anagnostopoulos et al.
6,474,795 B1 11/2002 Lebens et al.
6,478,395 B2 11/2002 Tanaka et al.
6,481,835 B2 11/2002 Hawkins et al.
6,485,123 B2 11/2002 Silverbrook
6,485,130 B2 11/2002 DeLouise et al.
6,485,133 B1 11/2002 Teramac et al.
6,488,349 B1 12/2002 Matsuo et al.
6,488,361 B2 12/2002 Silverbrook
6,488,367 B1 12/2002 Debesis et al.
6,491,362 B1 12/2002 Jeanmaire
6,491,376 B2 12/2002 Trauernicht et al.
6,491,385 B2 12/2002 Anagnostopoulos et al.
6,491,833 B1 12/2002 Silverbrook
6,494,554 B1 12/2002 Horii et al.
6,494,555 B1 12/2002 Ishikawa
6,494,556 B1 12/2002 Sayama et al.
6,494,566 B1 12/2002 Kishino et al.
6,497,019 B1 12/2002 Yun
6,499,820 B2 12/2002 Taki
6,502,306 B2 1/2003 Silverbrook
6,502,914 B2 1/2003 Hosono et al.
6,502,925 B2 1/2003 Anagnostopoulos et al.
6,503,408 B2 1/2003 Silverbrook
6,504,701 B1 1/2003 Takamura et al.
6,505,922 B2 1/2003 Hawkins et al.
6,507,099 B1 1/2003 Silverbrook
6,508,532 B1 1/2003 Hawkins et al.
6,508,543 B2 1/2003 Hawkins et al.
6,508,947 B2 1/2003 Gulvin et al.
6,513,894 B1 2/2003 Chen et al.
6,513,903 B2 2/2003 Sharma et al.
6,513,908 B2 2/2003 Silverbrook
6,517,176 B1 2/2003 Chaug
6,517,178 B1 2/2003 Yamamoto et al.
6,517,267 B1 2/2003 Otsuki
6,521,513 B1 2/2003 Lebens et al.
6,523,923 B2 2/2003 Sekiguchi
6,526,658 B1 3/2003 Silverbrook 6,527,354 B2 3/2003 Takahashi
6,527,357 B2 3/2003 Sharma et al.
6,527,365 B1 3/2003 Silverbrook
6,530,653 B2 3/2003 Le et al.
6,533,378 B2 3/2003 Ishikawa
6,533,390 B1 3/2003 Silverbrook
6,536,874 B1 3/2003 Silverbrook
6,536,883 B2 3/2003 Hawkins et al.
6,537,735 B1 3/2003 McCullough et al.
6,540,319 B1 4/2003 Silverbrook
6,540,332 B2 4/2003 Silverbrook
6,540,338 B2 4/2003 Takahashi et al.
6,546,628 B2 4/2003 Silverbrook
6,547,364 B2 4/2003 Silverbrook
6,547,371 B2 4/2003 Silverbrook
6,550,895 B1 4/2003 Silverbrook
6,553,651 B2 4/2003 Reznik et al.
6,554,410 B2 4/2003 Jeanmaire et al.
6,557,967 B1 5/2003 Lee
6,557,978 B2 5/2003 Silverbrook
6,561,608 B1 5/2003 Yamamoto et al.
6,561,614 B1 5/2003 Therien et al.
6,561,625 B2 5/2003 Maeng et al.
6,565,193 B1 5/2003 Silverbrook et al.
6,565,762 B1 5/2003 Silverbrook
6,566,858 B1 5/2003 Silverbrook et al.
6,568,797 B2 5/2003 Yamauchi et al.
6,572,210 B2 6/2003 Chaug
6,572,215 B2 6/2003 Sharma
6,572,715 B2 6/2003 Komine et al.
6,575,544 B2 6/2003 Iriguchi
6,575,549 B1 6/2003 Silverbrook
6,578,245 B1 6/2003 Chatterjee et al.
6,581,258 B2 6/2003 Yoneda et al.
6,582,043 B2 6/2003 Ishizaki
6,582,059 B2 6/2003 Silverbrook
6,588,882 B2 7/2003 Silverbrook
6,588,884 B1 7/2003 Furlani et al.
6,588,888 B2 7/2003 Jeanmaire et al.
6,588,889 B2 7/2003 Jeanmaire
6,588,890 B1 7/2003 Furlani et al.
6,588,952 B1 7/2003 Silverbrook et al.
6,594,898 B1 7/2003 Yun
6,595,617 B2 7/2003 Sharma et al.
6,595,620 B2 7/2003 Kubota et al.
6,599,757 B1 7/2003 Murai
6,629,739 B2 10/2003 Korol
6,629,756 B2 10/2003 Wang
6,641,744 B1 11/2003 Kawamura et al.
6,644,767 B2 11/2003 Silverbrook
6,655,795 B2 12/2003 Wachtel
6,659,583 B2 12/2003 Fujimori
6,672,704 B2 1/2004 Katakura et al.
6,682,170 B2 1/2004 Hotomi et al.
6,685,293 B2 2/2004 Junhua
6,755,511 B1 6/2004 Moynihan et al.
6,767,085 B2 7/2004 Murai
6,779,866 B2 8/2004 Junhua et al.
6,789,866 B2 9/2004 Sekiya et al.
6,793,311 B2 9/2004 Baba et al.
6,851,780 B2 2/2005 Fujimura et al.
6,857,715 B2 2/2005 Darling
6,896,346 B2 5/2005 Trauernicht et al.
6,923,520 B2 8/2005 Oikawa et al.
7,011,396 B2 3/2006 Moynihan et al.
7,052,117 B2 5/2006 Bibl et al.
7,281,778 B2 10/2007 Hasenbein et al.
7,303,264 B2 12/2007 Bibl et al.
7,478,899 B2 1/2009 Moynihan et al.
2001/0001458 A1 5/2001 Hashizume et al.
2001/0002135 A1 5/2001 Milligan et al.
2001/0002836 A1 6/2001 Tanaka et al.
2001/0007460 A1 7/2001 Fujii et al.
2001/0015001 A1 8/2001 Hashizume et al.
2001/0022596 A1 9/2001 Korol
2001/0023523 A1 9/2001 Kubby et al.
2001/0026294 A1 10/2001 Takahashi
2001/0028378 A1 10/2001 Lee et al.
2001/0032382 A1 10/2001 Lorraine et al.
2001/0033313 A1 10/2001 Ohno et al.
2001/0038404 A1 11/2001 Kitahara et al.
2001/0043241 A1 11/2001 Takahashi et al.
2002/0008738 A1 1/2002 Lee et al.
2002/0018082 A1 2/2002 Hosono et al.
2002/0018083 A1 2/2002 Sayama
2002/0018085 A1 2/2002 Asauchi et al.
2002/0018105 A1 2/2002 Usui et al.
2002/0024546 A1 2/2002 Chang
2002/0033644 A1 3/2002 Takamura et al.
2002/0033852 A1 3/2002 Chang
2002/0036666 A1 3/2002 Taki
2002/0036669 A1 3/2002 Hosono et al.
2002/0039117 A1 4/2002 Oikawa
2002/0041315 A1 4/2002 Kubota et al.
2002/0051039 A1 5/2002 Moynihan et al.
2002/0051042 A1 5/2002 Takagi et al.
2002/0054311 A1 5/2002 Kubo
2002/0057303 A1 5/2002 Takahashi et al.
2002/0060724 A1 5/2002 Le et al.
2002/0070992 A1 6/2002 Fukano
2002/0075360 A1 6/2002 Maeng et al.
2002/0080202 A1 6/2002 Sekiguchi
2002/0085065 A1 7/2002 Shimada et al.
2002/0089558 A1 7/2002 Suzuki et al.
2002/0096488 A1 7/2002 Gulvin et al.
2002/0096489 A1 7/2002 Lee et al.
2002/0097303 A1 7/2002 Gulvin et al.
2002/0101464 A1 8/2002 Iriguchi
2002/0109192 A1 8/2002 Hogyoku
2002/0122085 A1 9/2002 Chaug
2002/0122100 A1 9/2002 Nordstrom et al.
2002/0129478 A1 9/2002 Kishima
2002/0139235 A1 10/2002 Nordin et al.
2002/0145637 A1 10/2002 Umeda et al.
2002/0158926 A1 10/2002 Fukano
2002/0158927 A1 10/2002 Kojima
2002/0167559 A1 11/2002 Hosono et al.
2002/0184907 A1 12/2002 Vaiyapuri et al.
2003/0016272 A1 1/2003 Anagnostopoulos et al.
2003/0016275 A1 1/2003 Jeanmaire et al.
2003/0058309 A1 3/2003 Haluzak et al.
2003/0067500 A1 4/2003 Fujimura et al.
2003/0071138 A1 4/2003 Usuda
2003/0071869 A1 4/2003 Baba et al.
2003/0081025 A1 5/2003 Yonekubo
2003/0081040 A1 5/2003 Therien et al.
2003/0081073 A1 5/2003 Chen et al.
2003/0103095 A1 6/2003 Imai
2003/0107617 A1 6/2003 Okuda
2003/0107622 A1 6/2003 Sugahara
2003/0112297 A1 6/2003 Hiratsuka et al.
2003/0117465 A1 6/2003 Chwalek et al.
2003/0122885 A1 7/2003 Kobayashi
2003/0122888 A1 7/2003 Baba
2003/0122889 A1 7/2003 Okuda
2003/0131475 A1 7/2003 Conta
2003/0132823 A1 7/2003 Hyman et al.
2003/0136002 A1 7/2003 Nishikawa et al.
2003/0156157 A1 8/2003 Suzuki et al.
2003/0156158 A1 8/2003 Hirota et al.
2003/0156159 A1 8/2003 Kobayashi
2003/0156162 A1 8/2003 Hirota et al.
2003/0227497 A1 12/2003 Tamura
2003/0234826 A1 12/2003 Hosono et al.
2004/0004649 A1 1/2004 Bibl et al.
2004/0027405 A1 2/2004 Stoessel et al.
2004/0032467 A1 2/2004 Usui
2004/0061731 A1 4/2004 Fujimura et al.
2004/0085374 A1 5/2004 Berger et al.
2004/0113960 A1 6/2004 Usui
2004/0155915 A1 8/2004 Kitami et al.
2004/0207671 A1 10/2004 Kusunoki et al.
2005/0093903 A1 5/2005 Darling
2005/0200640 A1 9/2005 Hasenbein et al.
2005/0280675 A1 12/2005 Bibl et al.
2006/0181557 A1 8/2006 Hoisington et al.

| | | | |
|---|---|---|---|
| 2008/0074451 | A1 | 3/2008 | Hasenbein et al. |
| 2009/0079801 | A1 | 3/2009 | Moynihan et al. |
| 2010/0039479 | A1 | 2/2010 | Bibl et al. |

FOREIGN PATENT DOCUMENTS

| | | | |
|---|---|---|---|
| DE | 100 11 366 | | 1/2001 |
| EP | 0413340 | | 2/1991 |
| EP | 0422870 | | 4/1991 |
| EP | 0486256 | | 11/1991 |
| EP | 0667239 | | 8/1995 |
| EP | 0709200 | | 5/1996 |
| EP | 0736915 | | 10/1996 |
| EP | 0719642 | | 12/1996 |
| EP | 0839655 | | 5/1998 |
| EP | 0855273 | | 7/1998 |
| EP | 0916497 | | 5/1999 |
| EP | 0916500 | | 5/1999 |
| EP | 0949079 | | 10/1999 |
| EP | 0783410 | | 1/2000 |
| EP | 0969530 | | 1/2000 |
| EP | 0 979 732 | | 2/2000 |
| EP | 0980103 | | 2/2000 |
| EP | 0867289 | | 3/2000 |
| EP | 0985534 | | 3/2000 |
| EP | 1004441 | | 5/2000 |
| EP | 1123806 | | 8/2001 |
| EP | 1138492 | | 10/2001 |
| EP | 0963296 | | 1/2002 |
| EP | 1011975 | | 4/2002 |
| EP | 0983145 | | 9/2002 |
| EP | 1241009 | | 9/2002 |
| EP | 0973644 | | 1/2003 |
| EP | 1284188 | | 2/2003 |
| EP | 1321294 | | 6/2003 |
| EP | 1116591 | | 5/2006 |
| EP | 1836056 | | 9/2007 |
| JP | 60159064 | | 8/1985 |
| JP | 02-080252 | | 3/1990 |
| JP | 02184447 | | 7/1990 |
| JP | 05169654 | | 7/1993 |
| JP | 06-132756 | | 5/1994 |
| JP | 06-137438 | | 5/1994 |
| JP | 06-198876 | | 7/1994 |
| JP | 06-305141 | | 11/1994 |
| JP | 07241989 | | 9/1995 |
| JP | 8506540 | | 7/1996 |
| JP | 09-039232 | | 2/1997 |
| JP | 09-039234 | | 2/1997 |
| JP | 09-039238 | | 2/1997 |
| JP | 09-223831 | | 8/1997 |
| JP | 9272202 | | 10/1997 |
| JP | 9314863 | | 12/1997 |
| JP | 10058674 | | 3/1998 |
| JP | 10-264385 | | 10/1998 |
| JP | 11-058737 | | 3/1999 |
| JP | 11-216880 | A | 8/1999 |
| JP | 11-334088 | | 12/1999 |
| JP | 2001-010040 | | 1/2001 |
| JP | 2001-088294 | | 4/2001 |
| JP | 2001-260355 | | 9/2001 |
| JP | 2001-334674 | | 12/2001 |
| JP | 2002-079668 | | 3/2002 |
| JP | 2002-173375 | | 6/2002 |
| JP | 2002-187271 | | 7/2002 |
| JP | 2003-175601 | A | 6/2003 |
| KR | 2007-0087223 | | 8/2007 |
| TW | 200304014 | | 9/2003 |
| WO | 98/08687 | | 3/1998 |
| WO | WO 98/42517 | | 10/1998 |
| WO | WO 00/21755 | | 10/1999 |
| WO | WO02/098576 | | 12/2002 |
| WO | WO03/026897 | | 4/2003 |
| WO | 2005/000589 | | 1/2005 |
| WO | WO 2006/074016 | | 7/2006 |

OTHER PUBLICATIONS

U.S. Appl. No. 10/879,689 (issued as patent No. 7,011,396).
U.S. Appl. No. 11/336,423 (issued as patent No. 7,478,899).
U.S. Appl. No. 12/326,615 (published as US 2009/0079801).
U.S. Appl. No. 10/800,467 (issued as patent No. 7,281,778).
U.S. Appl. No. 11/864,250 (published as US 2008/0074451).
U.S. Appl. No. 11/214,681 (issued as patent No. 7,303,264).
U.S. Appl. No. 11/213,596 (published as US 2005/0280675).
U.S. Appl. No. 10/189,947 (issued as patent No. 7,052,117).
U.S. Appl. No. 11/279,496 (published as US 2006/0181557).
U.S. Appl. No. 12/486,693 (published as US 2010-0039479).
Pending claims from U.S. Appl. No. 11/279,496, filed Apr. 12, 2006.
Pending claims from U.S. Appl. No. 11/321,941, filed Dec. 29, 2005.
Pending claims from U.S. Appl. No. 11/864,250, filed Sep. 28, 2007.
Pending claims from U.S. Appl. No. 12/326,615.
Pending claims from U.S. Appl. No. 11/213,596, filed Aug. 26, 2005.
Pending claims from U.S. Appl. No. 12/486,693, filed Jun. 17, 2009.
Office Action from Canadian application No. 2386737 dated Jun. 22, 2006.
Office Action from Canadian application No. 2386737 dated Jul. 11, 2007.
Office Action from Canadian application No. 2620776 dated Mar. 11, 2009.
Examination Report from European application No. 06 01 5045.5 dated Mar. 3, 2008.
Office Action from European application No. 06 01 5045.5 dated Feb. 7, 2008.
European Search Report from European application No. 06 01 5045.5 dated Oct. 24, 2006.
Examination Report from Australian application No. 2003-247683 dated Mar. 26, 2008.
Examination Report from Australian application No. 2003-247683 dated Apr. 24, 2007.
Office Action from Chinese application No. 038199505 dated Sep. 8, 2006.
Office Action from Japanese application No. 2004-519728 dated Jul. 3, 2008.
Office Action from Korean application No. 10-2004-7021621 dated May 18, 2007.
Office Action from Korean application No. 10-2004-7021621 dated Oct. 27, 2006.
Office Action from Korean application No. 10-2007-7021241 dated Mar. 17, 2009.
International Preliminary Report on Patentability from PCT Application No. PCT/US2003/20730 dated Aug. 26, 2005.
International Search Report from PCT Application No. PCT/US2003/20730 dated Mar. 25, 2004.
Office Action from Chinese application No. 200580014141.8dated Jun. 24, 2008.
Office Action from Chinese application No. 2005800456475 dated Feb. 6, 2009.
European Supplemental Search Report from EP application No. 05725642.2 dated Mar. 26, 2008.
International Preliminary Report on Patentability from PCT Application No. PCT/US2005/008606 dated Sep. 19, 2006.
International Search Report from PCT Application No. PCT/US2005/008606 dated Apr. 20, 2006.
International Preliminary Report on Patentability from PCT Application No. PCT/US2005/047302 dated Jul. 3, 2007.
International Search Report from PCT Application No. PCT/US2005/047302 dated Dec. 19, 2006.
First Office Action, Jun. 19, 2009, Chinese Patent Office (office action issued in co-pending Chinese application No. 200710161961.0).
Notice of Reasons for Rejection, Jul. 3, 2009, Japanese Patent Office (office action issued in co-pending Japanese application No. 2007-250120).
Japanese Office Action for App. Ser. No. 2001-527993, dated Oct. 27, 2009 (English translation included), 7 pages.
International Search Report for Application No. PCT/US00/41084, dated Apr. 18, 2001, 3 pages.
International Preliminary Examination Report for Application No. PCT/US00/41084, dated Dec. 28, 2001, 8 pages.
Partial International Search Report for Application No. PCT/US03/20730, dated Oct. 22, 2003, 5 pages (Annex to Invitation to Pay Additional Fees).

European Supplemental Search Report for Application No. EP 05 85 5801, dated Dec. 7, 2009, 8 pages.
Balfrey Prescision, Products, Machine Tools, 4 pages Available Web Site: http://www.west.net/~btinc/page38,html and http://www.west.net/~btinc/page2.html.
Fromm, J.E., "Numerical calculation of the fluid dynamics of drop-on-demand jets," *IBM J. Res. Develop.,* 28(3):322-333 (1984).
Microfabrication and Micromachining, 34 pages Available Web Site: http://mems.cwru.edu/shortcourse/partI_2.html.
Mills et al., "Drop-on-demand ink jet technology for color printing," *SID 82 Digest,* 13:156-157 (1982).
Abstract U.S. Appl. No. 08/884,244, filed Apr. 18, 1997.
Abstract U.S. Appl. No. 08/808,608, filed Feb. 5, 1997.
Abstract U.S. Appl. No. 924,721, filed Aug. 29, 1998.
Abstract U.S. Appl. No. 920,496, filed Aug. 29, 1997.
Abstract U.S. Appl. No. 115,201, filed Jul. 15, 1998.
Abstract U.S. Appl. No. 116,014, filed Jul. 15, 1998.
Abstract U.S. Appl. No. 143,058, filed Aug. 28, 1998.
Abstract U.S. Appl. No. 143,059, filed Aug. 28, 1998.
Abstract U.S. Appl. No. 143,501, filed Aug. 28, 1998.
Abstract U.S. Appl. No. 225,179, filed Jan. 4, 1999.
Machine Language Translation of JP 09-039232, Feb. 10, 1997.
Machine Language Translation of JP 10-264385, Oct. 6, 1998.
Titles and abstracts of references generated from a computer key word search, dated Jul. 20, 2006, 125 pages.
Titles and abstracts of references generated from a computer key word search, dated Jul. 20, 2006, 86 pages.
Prior Product A and B as described in information disclosure statement transmittal filed Sep. 30, 2004 in U.S. Appl. No. 10/189,947.
International Preliminary Report on Patentability from PCT Application No. PCT/US2007/066159 dated Oct. 14, 2008, 11 pages.
International Search Report from PCT Application No. PCT/US2007/066159 dated Jun. 10, 2008, 16 pages.
Office action dated Apr. 6, 2010 from co-pending European application No. 05725642.2, 4 pgs.
Office action dated Mar. 26, 2010 from co-pending European application No. 05855801.6, 4 pgs.
Office action dated Sep. 13, 2010 issued in counterpart Japanese application No. 2007-504034, 4pgs.
Office action dated Aug. 13, 2010 issued in European application No. 08713698.2, 3 pgs. (252EP1).

* cited by examiner

EJECTION OF DROPS HAVING VARIABLE DROP SIZE FROM AN INK JET PRINTER

FIELD OF INVENTION

This invention relates to ink-jet printers, and in particular, to ink-jet printers capable of ejecting drops having variable drop sizes.

BACKGROUND

In a piezoelectric ink jet printer, a print head includes a large number of ink chambers, each of which is in fluid communication with an orifice and with an ink reservoir. At least one wall of the ink chamber is coupled to a piezoelectric material. When actuated, the piezoelectric material deforms. This deformation results in a deformation of the wall, which in turn launches a pressure wave that ultimately pushes ink out of the orifice while drawing in additional ink from an ink reservoir.

To provide greater density variations on a printed image, it is often useful to eject ink droplets of different sizes from the ink chambers. One way to do so is to sequentially actuate the piezoelectric material. Each actuation of the piezoelectric material causes a bolus of ink to be pumped out the orifice. If the actuations occur at a frequency that is higher than the resonant frequency of the ink chamber, successive boluses will arrive at the orifice plate before the first bolus has begun its flight to the substrate. As a result, all of the boluses merge together into one droplet. The size of this one droplet depends on the number of times actuation occurs before the droplet begins its flight from the orifice to the substrate. An ink jet printer of this type is disclosed in co-pending application Ser. No. 10/800,467, filed on Mar. 15, 2004, the contents of which are herein incorporated by reference.

SUMMARY

In one aspect, the invention features a method for causing ink to be ejected from an ink chamber of an ink jet printer. Such a method includes causing a first bolus of ink to be extruded from the ink chamber; and following lapse of a selected interval, causing a second bolus of ink to be extruded from the ink chamber. The interval is selected to be greater than the reciprocal of the fundamental resonant frequency of the chamber, and such that the first bolus remains in contact with ink in the ink chamber at the time that the second bolus is extruded.

Some practices include causing the second bolus to be ejected includes imparting, to the second bolus, a velocity in excess of a velocity of the first bolus.

Other practices include, following lapse of the selected interval, causing a third bolus of ink to be extruded from the ink chamber. In some of these practices, causing a third bolus of ink to be extruded includes imparting, to the third bolus, a velocity in excess of a velocity of the second bolus. Among these practices are those that also include causing the first, second, and third boluses to have respective first, second, and third momentums selected such that a drop lifetime of an ink-drop containing the first, second, and third boluses is equal to a drop lifetime of an ink-drop formed from two boluses of ink.

Other practices include those in which the interval is selected to be between about 15 microseconds and 16 microseconds.

Yet other practices include causing the first and second boluses to have first and second momentums selected such that a drop lifetime of an ink drop that contains the first and second boluses is equal to a drop lifetime of an ink drop formed from a single bolus of ink.

Additional practices include those in which causing first and second boluses of ink to be extruded includes selecting a combination of ejection pulses from a palette of pre-defined ejection pulses.

The invention also features, in another aspect, a method for ejecting ink from an ink chamber of an ink jet printer head. Such a method includes determining a first number of ink boluses needed to generate an ink drop having a selected drop size; extruding ink to form a free-surface fluid guide having a length that increases with time and extending between ink in the ink chamber and a leading ink bolus moving away from the orifice, and causing a set of follower ink boluses to travel along the free-surface fluid guide toward this leading bolus. The number of boluses in this set of follower boluses is one less than the first number. These boluses are temporally separated by an interval greater than the reciprocal of the fundamental resonant frequency of the ink chamber.

In some practices, causing a set of follower ink boluses to travel along the free-surface fluid guide includes causing the follower boluses to travel at velocities greater than a velocity of the leading bolus.

Other aspects of the invention include machine-readable media having encoded thereon software for causing execution of any of the foregoing methods.

In another aspect, the invention features a piezoelectric print head for an ink jet printer. Such a print head includes walls defining an ink chamber; a piezoelectric actuator in mechanical communication with the ink chamber; and a controller for controlling the piezoelectric actuator. The controller is configured to cause the piezoelectric actuator to cause extrusion of a first bolus of ink from the ink chamber, and following lapse of a selected interval, extrusion of a second bolus of ink from the ink chamber. The interval is selected to be greater than the reciprocal of the fundamental resonant frequency of the chamber. In addition, the interval is selected such that the first bolus remains in contact with ink in the ink chamber at the time that the second bolus is extruded.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION

Figure 1:
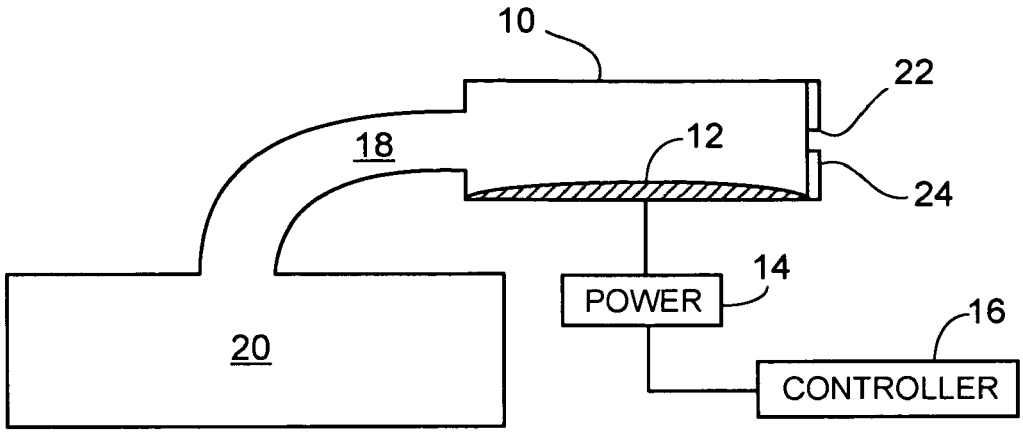
FIG. 1 shows an ink chamber from an ink jet print head.

FIG. 1 shows an ink chamber 10 associated with one of many ink jets in a piezoelectric print head of an ink jet printer. The ink chamber 10 has an active wall 12 coupled to a piezoelectric material that is connected to a power source 14 under the control of a controller 16. A passageway 18 at one end of the ink chamber 10 provides fluid communication with an ink reservoir 20 shared by many other ink chambers (not shown) of the print head. At the other end of the ink chamber 10, an orifice 22 formed by an orifice plate 24 provides fluid communication with the air external to the ink chamber 10.

In operation, the controller 16 receives instructions indicative of a size of a drop to be ejected. On the basis of the desired size, the controller 16 applies an excitation waveform to the active wall 12.

The excitation waveform includes a selection of one or more ejection pulses from a palette of pre-defined ejection pulses. Each ejection pulse extrudes a bolus of ink through the orifice 22. The number of ejection pulses selected from the palette and assembled into a particular excitation waveform depends on the size of the desired drop. In general, the larger the drop sought, the greater the number of boluses needed to form it, and hence, the more ejection pulses the excitation waveform will contain.

Figure 2:
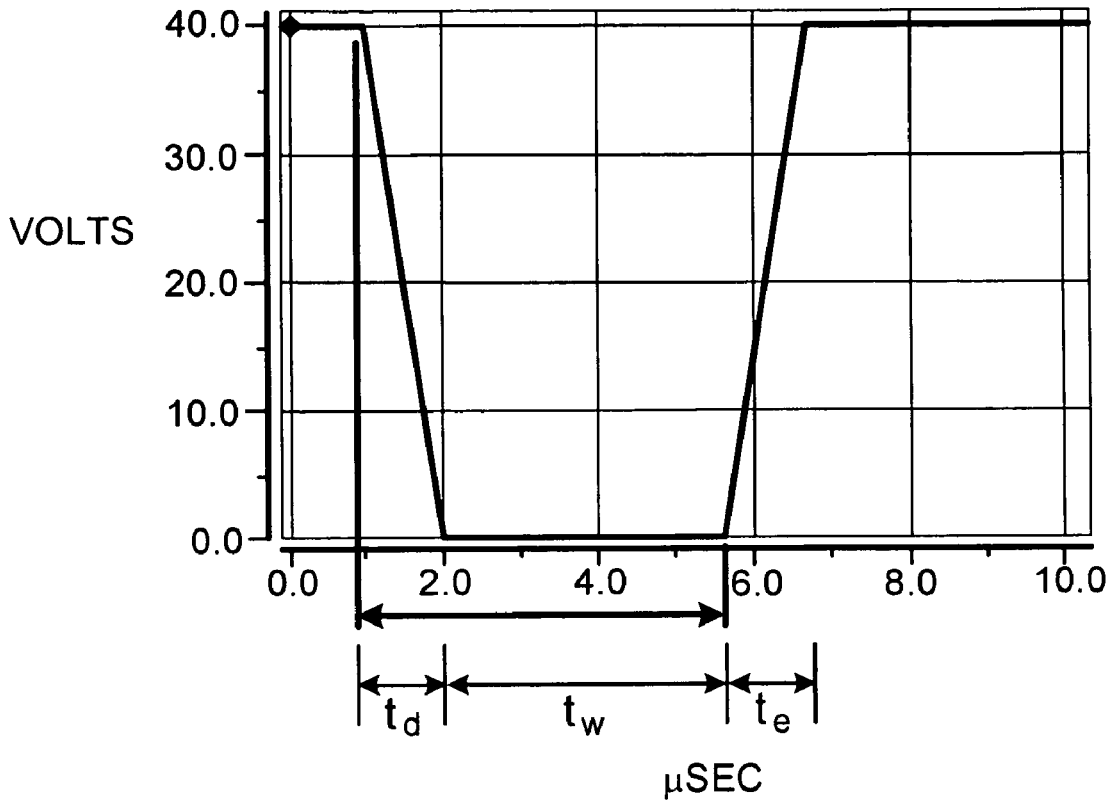
FIG. 2 shows an ejection pulse.

FIG. 2 shows one such pre-defined ejection pulse from a palette of ejection pulses. The ejection pulse begins with a draw phase in which the piezoelectric material is deformed so as to cause the ink chamber 10 to enlarge in volume. This causes ink to be drawn from the reservoir 20 and into the ink chamber 10.

The deformation that occurs during the draw phase results in a first pressure wave that originates at the source of the disturbance, namely the active wall 12. This first pressure wave travels away from the its source in both directions until it reaches a point at which it experiences a change in acoustic impedance. At that point, at least a portion of the energy in the first pressure wave is reflected back toward the source.

Following the lapse of a draw time $t_d$, a waiting phase begins. The duration of the waiting phase, referred to as the "wait time $t_w$", is selected to allow the above-mentioned pressure wave to propagate outward from the source, to be reflected at the point of impedance discontinuity, and to return to its starting point. This duration thus depends on velocity of wave propagation within the ink chamber 10 and on the distance between the source of the wave and the point of impedance discontinuity.

Following the waiting phase, the controller 16 begins an ejection phase having a duration defined by an ejection time $t_e$. In the ejection phase, the piezoelectric material deforms so as to restore the ink chamber 10 to its original volume. This initiates a second pressure wave. By correctly setting the duration of the waiting phase, the first and second pressure waves can be placed in phase and therefore be made to add constructively. The combined first and second pressure waves thus synergistically extrude a bolus of ink through the orifice 22.

The extent to which the piezoelectric material is deformed during the draw phase governs the momentum associated with the bolus formed as a result of the ejection pulse.

Figure 3:
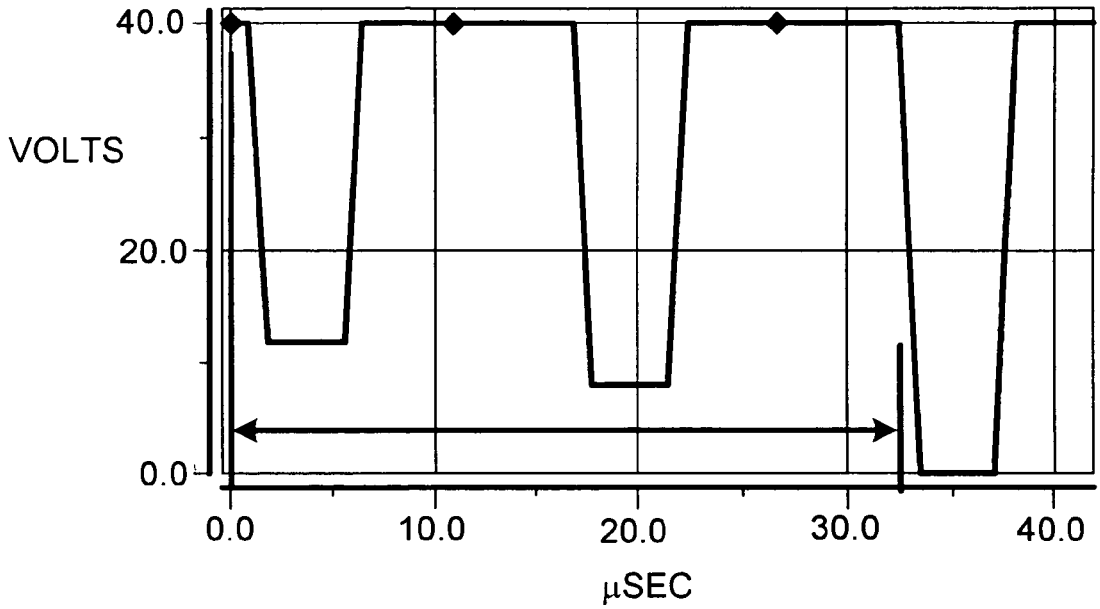
FIG. 3 shows a palette having three ejection pulses.

FIG. 3 shows an ejection pulse palette having three ejection pulses. Each ejection pulse is characterized by, among other attributes, a pulse amplitude and a pulse delay. The pulse amplitude controls the momentum of a bolus formed by the ejection pulse. The pulse delay of an ejection pulse is the time interval between a reference time and a particular event associated with the ejection pulse. A useful choice for a reference time is the time at which the printer control circuitry sends a trigger pulse. This time can be viewed as the start of an excitation waveform. A useful choice for an event to mark the other end of the pulse delay is the start of the ejection pulse.

FIG. 3 can also be viewed as an excitation waveform that uses all three ejection pulses available in an excitation palette. Other excitation waveforms would include subsets of the three available ejection pulses. For example, a two-bolus ink drop would be formed by an excitation waveform having only the first and third ejection pulses, only the first and second ejection pulses, or only the second and third ejection pulses. A one-bolus ink drop would be formed by an excitation waveform having only one of the three available ejection pulses.

Figure 4:
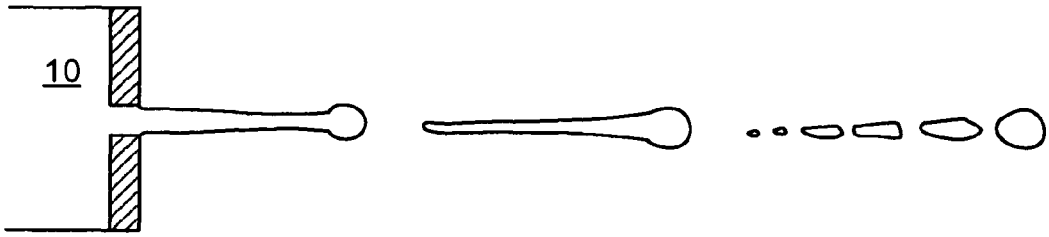
FIG. 4 shows independent ink droplets on their way to a substrate

In a first mode of operation, the intervals between the consecutive pulses are relatively long. When operated in this manner, the bolus extruded by the first pulse begins its flight from the orifice plate 24 to the substrate before extrusion of the second bolus. This first mode of operation thus leads to a series of independent droplets flying toward the substrate as shown in FIG. 4. These droplets combine with each other, either in flight or at the substrate, to form a larger drop.

Figure 5:
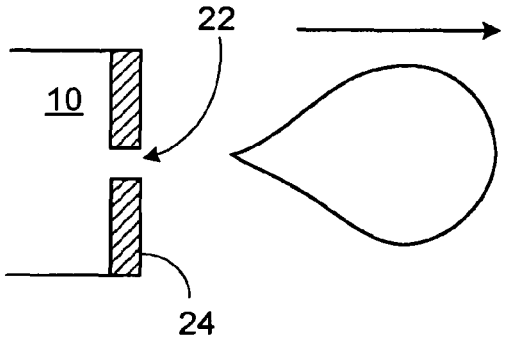
FIG. 5 shows a single large ink drop on its way to the substrate.

The long tails connected to the droplets shown in FIG. 4 break up into satellites during their flight. These tails may then land on the substrate in an uncontrolled way. Uncontrolled distribution of ink from these tails thus causes stray marks on the substrate, and thereby undermines print quality. In a second mode of operation, the intervals between ejection pulses are very short. When operated in this rapid-fire manner, the boluses are extruded so rapidly that they combine with each other while still attached to ink on the orifice plate 24. This results in the formation of a single large drop, as shown in FIG. 5, which then leaves the orifice plate 24 fully formed. This second mode of operation avoids the formation of a great many tails.

Figure 6:
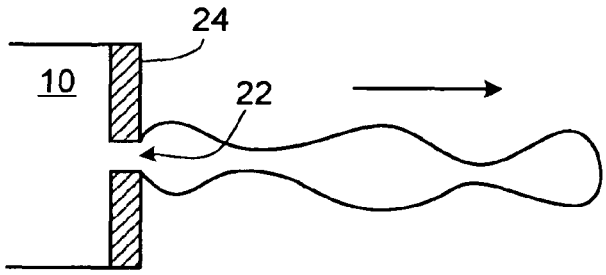
FIG. 6 shows boluses of ink that combine to form an ink drop.

In a third mode of operation, the intervals between the ejection pulses are chosen to be long enough to avoid rectified diffusion, but short enough so that the boluses extruded by the sequence of pulses remain connected to each other by ligaments as they leave the orifice plate 24 on their way to the substrate. An exemplary string of such boluses is shown in FIG. 6.

In this third mode of operation, the surface tension associated with the inter-bolus ligaments tends to draw the boluses together into a single drop. This avoids the formation of many long tails that may spatter uncontrollably onto the substrate.

The exact numerical parameters associated with the ejection pulses depends on the details of the particular ink chamber 10 and on the properties of the ink. However, as a general rule, the time interval between ejection pulses corresponds to a frequency that is lower than the fundamental resonant frequency of the ink chamber 10, but not so low that the boluses separate from each other and form discrete droplets, as shown in FIG. 4. This time interval between ejection pulses is thus greater than the reciprocal of the fundamental (i.e. lowest) resonant frequency expressed in cycles per second.

For the case of an ink having a viscosity of 11 cps at 40° C., FIG. 3 is an exemplary excitation waveform for forming drops having a mass as high as 20 ng and doing so at a rate sufficient to eject such a drop every 50 microseconds (i.e. at a drop ejection frequency of 20 kHz). The ejection pulses are separated from each other by approximately 15-16 microseconds (i.e., at a pulse repetition frequency of 63.5 kHz).

Figure 8:
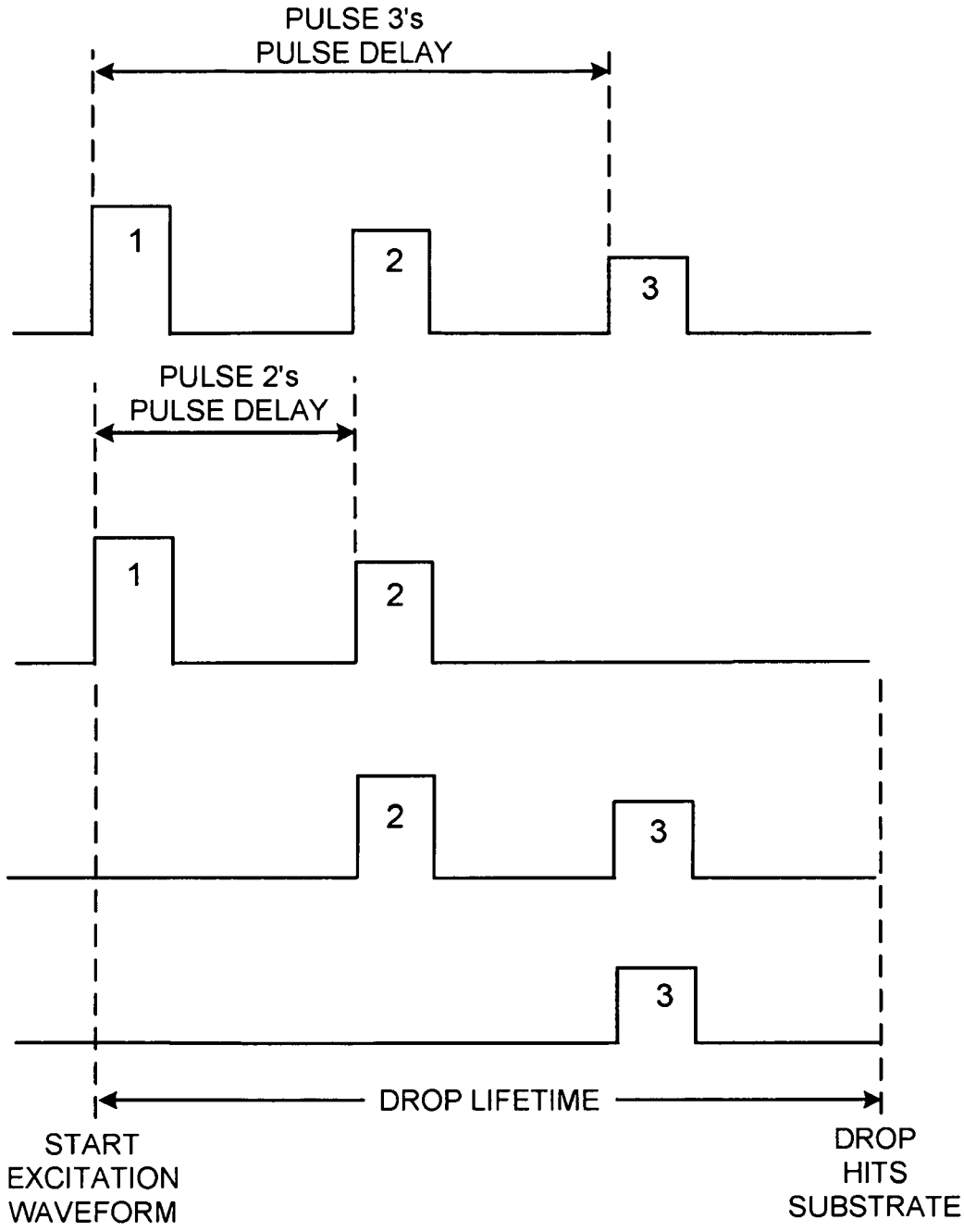
FIG. 8 illustrates drop lifetime and pulse delay.

The amplitudes and pulse delays of the ejection pulses available for assembling the excitation waveform are selected so that the interval between the start of the excitation waveform and the time the ink drop formed by that waveform hits the substrate (referred to herein as the "drop lifetime") is independent of the size of the ink drop. As used herein, and as illustrated in FIG. 8, the start of the excitation waveform need not coincide with the start of the first ejection pulse used in that waveform. For example, if the excitation waveform for a particular drop uses only the second of the three available ejection pulses, then the start of the excitation waveform is considered to be the time at which the first ejection pulse would have begun had the first ejection pulse been used. The judicious selection of ejection pulse amplitudes and delays in this way means that the time at which the print-head driving circuit sends a trigger signal is independent of the drop size. Rather, what changes as a function of drop size is the selection, from the palette of ejection pulses, of those ejection pulses that constitute the particular excitation waveform for that ink drop. This greatly simplifies the design of the drive circuit.

Although FIG. 8 shows upwardly extending pulses, this is not meant to imply anything about the actual signs of voltages and currents used in the driving circuitry. It is to ensure this generality that the vertical axis of FIG. 8 omits any reference to polarity.

In the particular palette of ejection pulses shown in FIG. 3, the voltage drop increases with pulse delay. As a result, the first bolus formed has the lowest momentum and the subsequent boluses have successively higher momentums. This allows the later formed boluses to more easily catch up with the earlier formed boluses.

While the palette of ejection pulses shown in FIG. 3 has only three ejection pulses, the principles described herein can readily be applied to excitation waveforms that have any number of ejection pulses.

Figure 7:
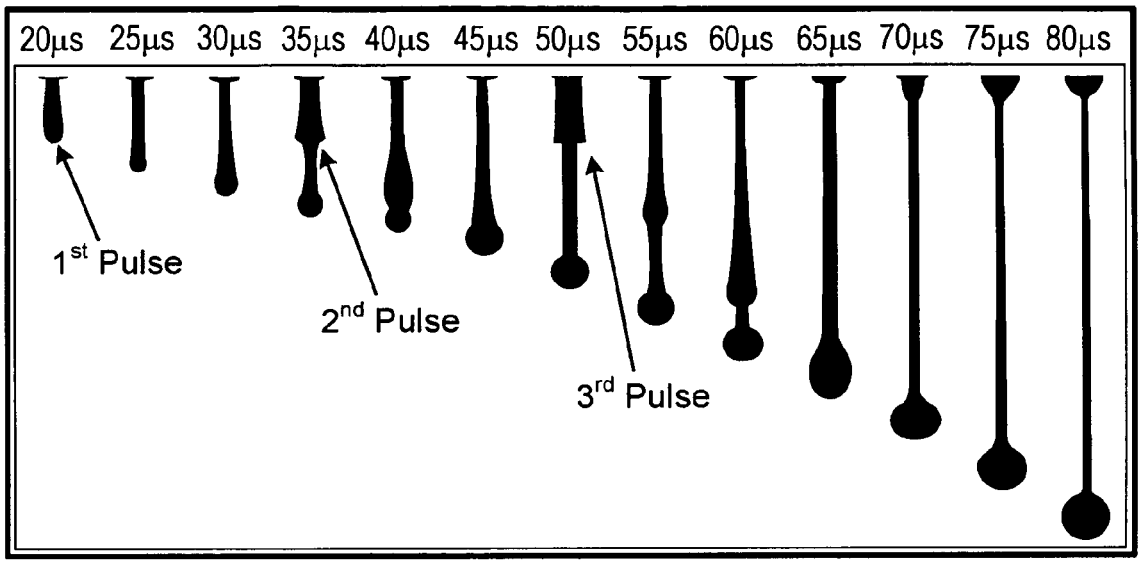
FIG. 7 shows boluses of ink produced by the excitation waveform of FIG. 3.

FIG. 7 shows photographs taken every 5 microseconds and placed side-by-side to show three boluses combining to form a single drop. By the 30 microsecond mark, a slow-moving first bolus threatens to disconnect itself from the orifice plate and begin its flight to the substrate. The first bolus, however, continues to be in contact with ink within the ink chamber 10 through a ligament.

Then, at 35 microseconds, while the first bolus is still in contact with ink within the ink chamber 10, a faster moving second bolus begins to catch up to the first bolus. In doing so, the second bolus travels along the ligament that connects the first bolus to the ink in the ink chamber 10.

At 40 microseconds, the first and second boluses begin to merge, and by 45 microseconds, the drop has grown by the mass of the second bolus. Meanwhile, the ligament continues to stretch.

By 50 microseconds, a fast-moving third bolus has emerged from the orifice and rapidly moves up the ligament to join the drop formed by the first and second boluses. Within the next 15 microseconds, the third bolus catches up with the drop and merges into it. Then, over the next ten microseconds, the drop, which now has the accumulated mass of three boluses, finally breaks free of the orifice plate and begins its flight to the substrate.

Excitation waveforms for forming smaller drops will extrude fewer boluses. As a result, such excitation waveforms will be like that shown in FIG. 3 but with fewer ejection pulses. For example, one can generate a small ink drop by selecting only one of the pre-defined ejection pulses from FIG. 3, or one can generate a slightly larger ink drop by selecting two of the three pre-defined ejection pulses shown in FIG. 3. In one practice, the second ejection pulse of FIG. 3 by itself to creates a one-bolus ink drop, the first and third ejection pulses of FIG. 3 cooperate to create a two-bolus ink drop, and all three ejection pulses shown in FIG. 3 cooperate to create a three-bolus ink drop. However, depending on the specific combination of pulse delays and amplitudes that are available in a palette of ejection pulses, different combinations of ejection pulses can be chosen. For example, in some cases, the first or third ejection pulses can be used to create a one-bolus drop. In other cases, either the first and second pulses or the second and third pulses can cooperate to create a two-bolus ink drop.

In some printers, four or more ink drop sizes may be available, in which case the palette of ejection pulses will have four or more available ejection pulses.

In general, the ensemble of ejection pulses available for assembly into an excitation waveform includes ejection pulses having amplitudes and delays selected to maximize the number of different ink-drop sizes that can be created, subject to the constraint that the drop lifetime be independent of the drop size. In some cases, this includes providing a large drop with sufficient momentum so that the velocity of the large drop is the same as that of a smaller drop. Or, if the large and small drops have velocities that differ, one can choose ejection pulses with longer delays for the faster moving drop, thereby giving the slower-moving drop a head start. In such cases, the faster-moving drop and the slower-moving drop would arrive at the substrate at the same time.

In the case of multi-bolus ink drops, the ink mass associated with the tail is capped by the ink-mass of the bolus formed by the last of the ejection pulses. As a result, the mass of the tail is not proportional to the mass of the ink drop. Instead, as the ink drop becomes larger, the ratio of the tail's mass to that of the ink drop becomes progressively smaller.

In the drop formation process shown in FIG. 7, the ligament effectively forms a dynamically lengthening free-surface fluid guide, or transmission line, for the propagation of pressure pulses from the ink chamber 10 to the first bolus. These pressure pulses cause additional boluses to travel up the transmission line toward the first bolus.

The fluid guide is a "free-surface" fluid guide because the surface of the fluid guide is also the surface of the fluid. The fluid guide is thus held together by the surface tension of the ink that forms the ligament. As a result, the greater the ink's surface tension, the longer the fluid guide can be maintained, and the more time there will be for successive boluses to travel down the guide to merge with the leading bolus.

Having described the invention, and a preferred embodiment thereof, what is claimed as new, and secured by Letters Patent is:

1. A method for causing ink to be ejected from an ink chamber of an ink jet printer, the method comprising:

selecting a combination of ejection pulses from a palette of pre-defined ejection pulses to form an excitation waveform, wherein at least two of the pre-defined ejection pulses are different, and the excitation waveform includes a number of ejection pulses equal to or less than a total number of ejection pulses from the palette, applying a first pulse from the excitation waveform to an active wall of the ink chamber to cause a first bolus of ink to be extruded from the ink chamber;

following lapse of a selected interval, applying a second pulse from the excitation waveform to cause a second bolus of ink to be extruded from the ink chamber;

wherein the interval is selected to be greater than the reciprocal of the fundamental resonant frequency of the chamber, and wherein the interval is selected such that the first bolus remains in contact with ink in the ink chamber at the time that the second bolus is extruded, whereby in an ink drop that includes the first and second boluses, the first and second boluses remain connected by a ligament as the ink drop leaves an orifice plate of the ink jet printer, wherein the ink drop formed from the first and second boluses has a velocity different from an ink drop formed from a single bolus, and wherein each ejection pulse in the excitation waveform includes a pulse amplitude and a pulse delay, the pulse delay is the time between a start of an excitation waveform and a start of the ejection pulse, and the method further comprises selecting ejection pulses with pulse amplitudes and pulse delays such that a drop lifetime of the ink drop that contains the first and second boluses is equal to a drop lifetime of the ink drop formed from the single bolus of ink.

2. The method of claim 1, wherein causing the second bolus to be ejected comprises imparting, to the second bolus, a velocity in excess of a velocity of the first bolus.

3. The method of claim 1, further comprising, following lapse of the selected interval, causing a third bolus of ink to be extruded from the ink chamber.

4. The method of claim 3, wherein causing a third bolus of ink to be extruded comprises imparting, to the third bolus, a velocity in excess of a velocity of the second bolus.

5. The method of claim 4, further comprising causing the first, second, and third boluses to have respective first, second, and third momentums selected such that a drop lifetime of an ink-drop containing the first, second, and third boluses is equal to a drop lifetime of an ink-drop formed from two boluses of ink.

6. The method of claim 1, further comprising selecting the interval to be between about 15 microseconds and 16 microseconds.

7. The method of claim 1, wherein the pulse amplitudes of the first pulse and second pulse are different.

8. A method for ejecting ink from an ink chamber of an ink jet printer head, the method comprising:

determining a first number of boluses of ink required to generate an ink drop having a selected drop size;

selecting a combination of ejection pulses from a palette of pre-defined ejection pulses to form an excitation waveform for the selected drop size, wherein at least two of the pre-defined ejection pulses are different, and the excitation waveform includes a number of ejection pulses equal to or less than a total number of ejection pulses from the palette;

applying the excitation waveform to an active wall of the ink chamber;

extruding ink to form a free-surface fluid guide having a length that increases with time, the free-surface fluid guide extending between ink in the ink chamber and a leading bolus of ink moving away from an orifice plate;

causing a set of follower ink boluses to travel along the free-surface fluid guide toward the leading bolus, the set of follower boluses having a number of boluses that is one less than the first number, the boluses being temporally separated by an interval greater than the reciprocal of the fundamental resonant frequency of the ink chamber, whereby the ink boluses remain connected by a ligament as the ink drop leaves the orifice plate of the ink jet printer wherein the ink drop formed from the first number of boluses has a velocity different from an ink drop formed from a single bolus, and wherein each ejection pulse in the excitation waveform includes a pulse amplitude and a pulse delay, the pulse delay is the time between a start of an excitation waveform and a start of the ejection pulse, and the method further comprises selecting ejection pulses with pulse amplitudes and pulse delays such that a drop lifetime of the ink drop that contains the first number of boluses is equal to a drop lifetime of the ink drop formed from the single bolus of ink.

9. The method of claim 8, wherein causing a set of follower ink boluses to travel along the free-surface fluid guide comprises causing the follower boluses to travel at velocities greater than a velocity of the leading bolus.

10. A machine-readable medium having encoded thereon software for causing ink to be ejected from an ink chamber of an ink jet printer, the software comprising instructions for:

selecting a combination of ejection pulses from a palette of pre-defined ejection pulses to form an excitation waveform, wherein at least two of the pre-defined ejection pulses are different, and the excitation waveform includes a number of ejection pulses equal to or less than a total number of ejection pulses from the palette, applying a first pulse from the excitation waveform to an active wall of the ink chamber to cause a first bolus of ink to be extruded from the ink chamber;

following lapse of a selected interval, applying a second pulse from the excitation waveform to cause a second bolus of ink to be extruded from the ink chamber;

wherein the interval is selected to be greater than the reciprocal of the fundamental resonant frequency of the chamber, and wherein the interval is selected such that the first bolus remains in contact with ink in the ink chamber at the time that the second bolus is extruded, whereby in an ink drop that includes the first and second boluses, the first and second boluses remain connected by a ligament as the ink drop leaves an orifice plate of the ink jet printer, wherein the ink drop formed from the first and second boluses has a velocity different from an ink drop formed from a single bolus; and wherein each ejection pulse in the excitation waveform includes a pulse amplitude and a pulse delay, the pulse delay is the time between a start of an excitation waveform and a start of the ejection pulse, and the software further comprises instructions for selecting ejection pulses with pulse amplitudes and pulse delays such that a drop lifetime of the ink drop that contains the first and second boluses is equal to a drop lifetime of the ink drop formed from the single bolus of ink.

11. The machine-readable medium of claim 10, wherein the instructions for causing the second bolus to be ejected comprise instructions for imparting, to the second bolus, a velocity in excess of a velocity of the first bolus.

12. The machine-readable medium of claim 10, wherein the software further comprises instructions for, following lapse of the selected interval, causing a third bolus of ink to be extruded from the ink chamber.

13. The machine-readable medium of claim 12, wherein the instructions for causing a third bolus of ink to be extruded comprise instructions for imparting, to the third bolus, a velocity in excess of a velocity of the second bolus.

14. The machine-readable medium of claim 13, wherein the software further comprises instructions for causing the first, second, and third boluses to have respective first, second, and third momentums selected such that a drop lifetime of an ink-drop containing the first, second, and third boluses is equal to a drop lifetime of an ink-drop formed from two boluses of ink.

15. The machine-readable medium of claim 10, wherein the software further comprises instructions for selecting the interval to be between about 15 microseconds and 16 microseconds.

16. The method of claim 10, wherein the pulse amplitudes of the first pulse and second pulse are different.

17. A machine-readable medium having encoded thereon software for ejecting ink from an ink chamber of an ink jet printer head, the software comprising instructions for:

determining a first number of boluses of ink required to generate an ink drop having a selected drop size;

selecting a combination of ejection pulses from a palette of pre-defined ejection pulses to form an excitation waveform for the selected drop size, wherein at least two of the pre-defined ejection pulses are different, and the excitation waveform includes a number of ejection pulses equal to or less than a total number of ejection pulses from the palette;

applying the excitation waveform to an active wall of the ink chamber;

extruding ink to form a free-surface fluid guide having a length that increases with time, the free-surface fluid guide extending between ink in the ink chamber and a leading bolus of ink moving away from an orifice plate;

causing a set of follower ink boluses to travel along the free-surface fluid guide toward the leading bolus, the set of follower boluses having a number of boluses that is one less than the first number, the boluses being temporally separated by an interval greater than the reciprocal of the fundamental resonant frequency of the ink chamber, whereby the ink boluses remain connected to each other by a ligament as the ink drop leaves the orifice plate of the ink jet printer, wherein the ink drop formed from the first number of boluses has a velocity different from an ink drop formed from a single bolus, and wherein each ejection pulse in the excitation waveform includes a pulse amplitude and a pulse delay, the pulse delay is the time between a start of an excitation waveform and a start of the ejection pulse, and the software further comprises instructions for selecting ejection pulses with pulse amplitudes and pulse delays such that a drop lifetime of the ink drop that contains the first number of boluses is equal to a drop lifetime of the ink drop formed from the single bolus of ink.

18. The machine-readable medium of claim 17, wherein the instructions for causing a set of follower ink boluses to travel along the free-surface fluid guide comprise instructions for causing the follower boluses to travel at velocities greater than a velocity of the leading bolus.

19. A piezoelectric print head for an ink jet printer, the print head comprising:

walls defining an ink chamber;

a piezoelectric actuator in mechanical communication with the ink chamber;

a controller for controlling the piezoelectric actuator, the controller being configured to select a combination of ejection pulses from a palette of pre-defined ejection pulses to form an excitation waveform, wherein at least two of the pre-defined ejection pulses are different, and the excitation waveform includes a number of ejection pulses equal to or less than a total number of ejection pulses from the palette, the controller further configured to apply the excitation waveform to the piezoelectric actuator to cause extrusion of a first bolus of ink from the ink chamber, and following lapse of a selected interval, extrusion of a second bolus of ink from the ink chamber, wherein the interval is selected to be greater than the reciprocal of the fundamental resonant frequency of the chamber, wherein the interval is selected such that the first bolus remains in contact with ink in the ink chamber at the time that the second bolus is extruded, whereby in an ink drop that includes the first and second boluses, the first and second boluses remain connected by a ligament as the ink drop leaves an orifice plate of the ink jet printer, wherein the ink drop formed from the first and second boluses has a velocity different from an ink drop formed from a single bolus, and wherein each ejection pulse in the excitation waveform includes a pulse amplitude and a pulse delay, the pulse delay is the time between a start of an excitation waveform and a start of the ejection pulse, and the software further comprises instructions for selecting ejection pulses with pulse amplitudes and pulse delays such that a drop lifetime of the ink drop that contains the first and second boluses is equal to a drop lifetime of the ink drop formed from the single bolus of ink.

* * * * *

UNITED STATES PATENT AND TRADEMARK OFFICE

CERTIFICATE OF CORRECTION

PATENT NO. : 7,988,247 B2
APPLICATION NO. : 11/652325
DATED : August 2, 2011
INVENTOR(S) : William R. Letendre et al.

It is certified that error appears in the above-identified patent and that said Letters Patent is hereby corrected as shown below:

Column 9, Line 8, Claim 16:

Delete "The method" and insert --The machine-readable medium--

Signed and Sealed this
Thirty-first Day of January, 2012

David J. Kappos

David J. Kappos
*Director of the United States Patent and Trademark Office*